US005531380A

United States Patent [19]

Thompson, Sr.

[11] Patent Number: 5,531,380

[45] Date of Patent: Jul. 2, 1996

[54] NOZZLE DEVICE WITH JET SEAL AND METHOD

[76] Inventor: Earl E. Thompson, Sr., 7515 S. Erie, Tulsa, Okla. 74136

[21] Appl. No.: 213,240

[22] Filed: Mar. 15, 1994

[51] Int. Cl.[6] ..... B05B 3/06

[52] U.S. Cl. ..... 239/1; 239/251; 239/259

[58] Field of Search ..... 239/259, 251, 239/254, 256, 1

[56] References Cited

U.S. PATENT DOCUMENTS

| | | | |
|---|---|---|---|
| 486,829 | 11/1892 | Hart | 239/259 |
| 1,760,201 | 5/1930 | Macomber | 239/259 |
| 3,180,348 | 4/1965 | Clearman | 134/176 |
| 3,807,636 | 4/1974 | Fackler | 239/226 |
| 4,923,120 | 5/1990 | Hammelmann | 239/252 |
| 5,060,862 | 10/1991 | Pacht | 239/252 |
| 5,104,043 | 4/1992 | Pacht | 239/252 |
| 5,284,298 | 2/1994 | Haynes et al. | 239/254 |

*Primary Examiner*—Karen B. Merritt
*Attorney, Agent, or Firm*—Frank J. Catalano; Scott R. Zingerman

[57] ABSTRACT

The nozzle device having a plurality of spray orifices comprises a nozzle support rotatably mounted about a rotation axis and driveable by the reaction force of pressurized water issuing from the orifices. The nozzle device may be used with high operating pressures, high temperatures, corrosive environments and high-rotational speeds. The current embodiment is particularly designed for cleaning surfaces. A fluid-conducting swivel includes an acceleration nozzle, deceleration nozzle, and support assembly for holding the acceleration and deceleration nozzle with their flow passageways aligned, allowing rotation of one of the acceleration and deceleration nozzles, and maintaining a space between the adjacent ends of the nozzle. The acceleration nozzle includes an acceleration nozzle for accelerating the velocity of the fluid flow to such a velocity that the fluid creates a vena contracta, a substantially self-contained fluid jet. The deceleration nozzle includes a deceleration nozzle for decelerating the velocity of the fluid flow. The deceleration nozzle receives the accelerated fluid from the acceleration nozzle and is sized to substantially prevent expansion of the accelerated fluid and thereby prevent fluid leakage and pressure loss between the acceleration and deceleration nozzles.

14 Claims, 2 Drawing Sheets

NOZZLE DEVICE WITH JET SEAL AND METHOD

BACKGROUND—FIELD OF INVENTION

This invention is related to a fluid-conducting-swivel-nozzle device and the method for operating the same and, more particularly, but not by way of limitation, relates to a swivel which is free of friction generating seals.

BACKGROUND—DESCRIPTION OF PRIOR ART

Fluid-conducting swivels are known and commercially available. Applications include fluid-driven rotating machinery and tools and fluid-spraying rotating cleaning equipment. The prior art includes friction-generating seals to prevent fluid escaping between the relatively rotating parts of the swivel. The frictional drag impedes rotation or precludes proper rotation. Applications utilizing cleaning liquids which are relatively corrosive and under high pressures and temperatures can deteriorate seal materials rapidly.

U.S. Pat. No. 2,983,452 to Lindbloom (1961) and U.S. Pat. No. 3,386,662 to Kennedy et al (1968) both disclose rotary spraying devices having neoprene o-ring and fibre gasket sealing and compressed packing. All of these materials are friction generating, deteriorate rapidly and preclude any desired consistent rotation as the sealing materials wear.

My own U.S. Pat. No. 5,284,298 to Haynes/Thompson (1994) discloses a fluid seal swivel using a jet principle but suffers from several disadvantages:

(a) The upstream acceleration nozzle throat is 0.073 inches and the downstream acceleration nozzle throat is 0.076 inches. This difference in the fluid passage creates a loss in pressure.

(b) The fluid jet created by the acceleration nozzle is claimed to be substantially self-contained with minimal dissociation after leaving the acceleration nozzle throat before it is received by the deceleration nozzle throat. However, a jet created by this method has considerable dissociation upon leaving the throat. The fluid jet created by the claimed nozzle configuration is less efficient because the vena contracta is destroyed inside the upstream throat before the gap, and because of this destruction, turbulence within the throat is created.

(c) The manufacturing tolerances for the prior art are necessarily precise to maintain concentricity of the opposed orifice concept.

(d) The internal configuration of the acceleration nozzle and deceleration nozzle will not perform favorably under low pressure fluid conditions.

(e) The throat sections of the nozzles have a destructive effect upon the fluid seal concept because the straight throat causes frictional drag and substantial pressure loss.

OBJECTS AND ADVANTAGES

Accordingly, it is an object of the present invention to provide an improved nozzle device of the above described kind. The present invention exhibits a novel and unobvious method of making such a swivel. Several objects and advantages of the present invention are:

(a) to provide a fluid jet that is self-contained using the vena contracta concept with no substantial dissociation for use in a swivel design;

(b) to provide an opposed nozzle assembly with gradual sloping walls with substantially the same internal dimensions and that are interchangeable;

(c) to provide ease of manufacturing through less critical tolerance requirements and fewer parts;

(d) to provide a swivel that will operate within a broad range of pressures, volumes, temperatures, and revolutions; and (e) to provide a swivel with no friction generating seals.

Included among the objects and advantages of the present invention is an effective and durable swivel that uses the vena contracta concept. The novelty and unobviousness of the concept lies in the fact that a laminar fluid flow issuing from a properly designed cone nozzle will continue to contract in diameter downstream and outside of the nozzle walls to a point determined by the velocity of the jet, thereby creating a fluid jet stream that is smaller in diameter than the orifice from which it issued.

The object and advantage of creating the vena contracta is to capture the self-contained jet before or at the point of vena contracta within an opposed nozzle of identical internal dimensions to recover the maximum performance and substantially contain the fluid jet before dissociation occurs.

In keeping with these objects and with others, this nozzle device comprises a stationary housing with a central duct containing the vena contracta creating acceleration nozzle. The deceleration nozzle is contained within a hollow shaft that is rotatable around the central duct, but does not touch the duct. Sealed bearings are pressed onto the outer surface of the rotatable hollow shaft. The bearing and shaft assembly is then pressed into the stationary housing. Thus, the opposed nozzles are aligned. The hollow shaft rotatably mounted within the stationary housing has a threaded section on its downstream end to accept a preferred fluid user nozzle configuration to impart rotation from fluid thrust.

DRAWING FIGURES

The objects, features and advantages of my invention will be made more apparent from the following detailed description, reference being made to the accompanying drawings in which.

Reference Numerals In Drawings

| | | | |
|---|---|---|---|
| 20 | fluid conducting swivel | 22 | upstream conduit |
| 24 | downstream conduit | 26 | support means |
| 28 | gap | 30 | bearing assembly |
| 36 | first end of upstream conduit | 38 | fluid source |
| 40 | second end upstream conduit | 42 | fluid passageway |
| 44 | acceleration nozzle | 50 | axis of swivel |
| 56 | first end downstream conduit | 58 | fluid user |
| 60 | second end downstream conduit | 64 | deceleration nozzle |
| 72 | discharge nozzle | 76 | conduital arm |
| 78 | bearing retainer housing | 80 | inner bearing race |
| 82 | venting orifice | | |

DESCRIPTION—FIGS. 1 AND 2

Figure 1:
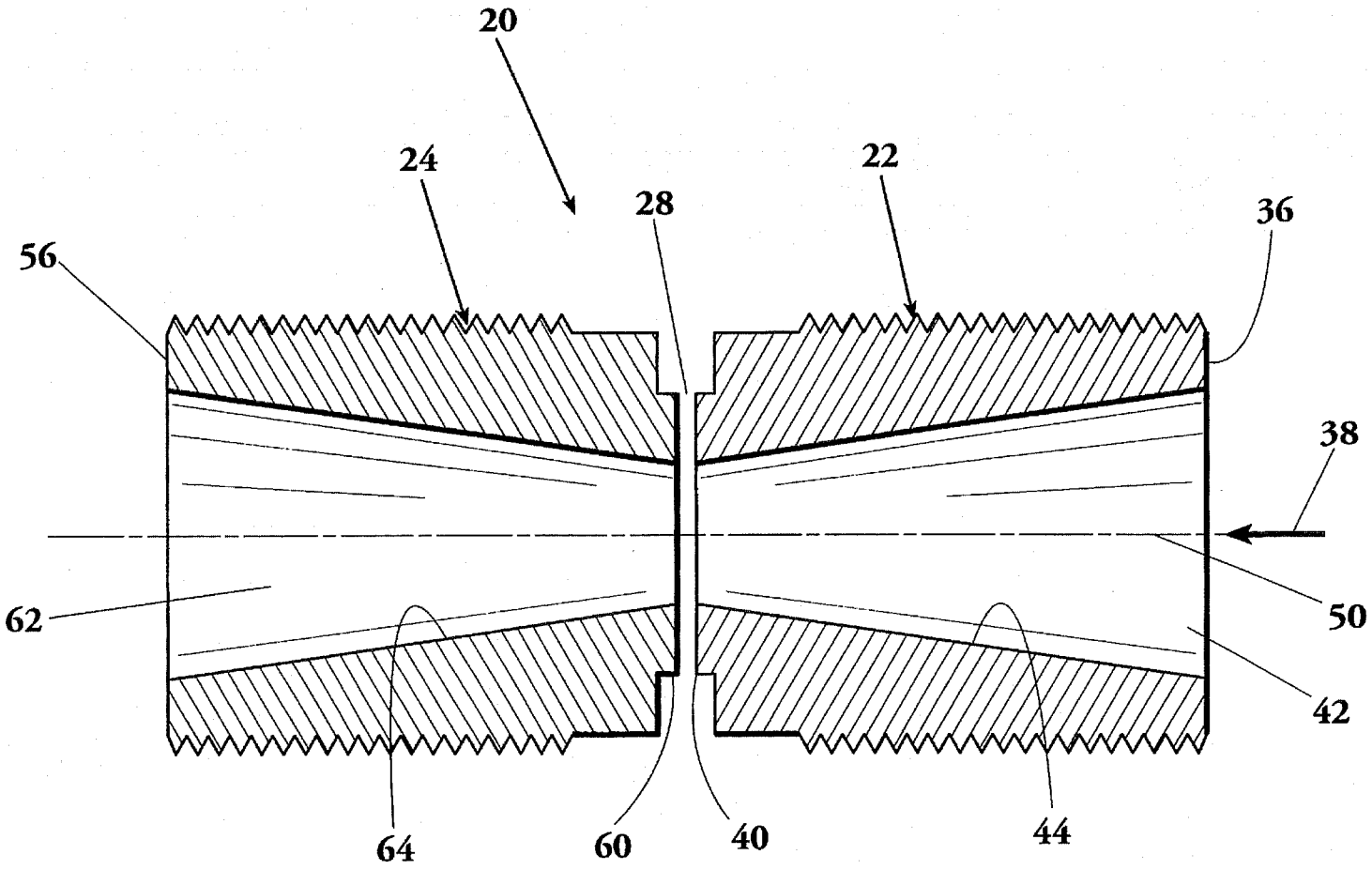
FIG. 1 is a schematic diagram of an embodiment of a swivel of the present invention.
Figure 2:
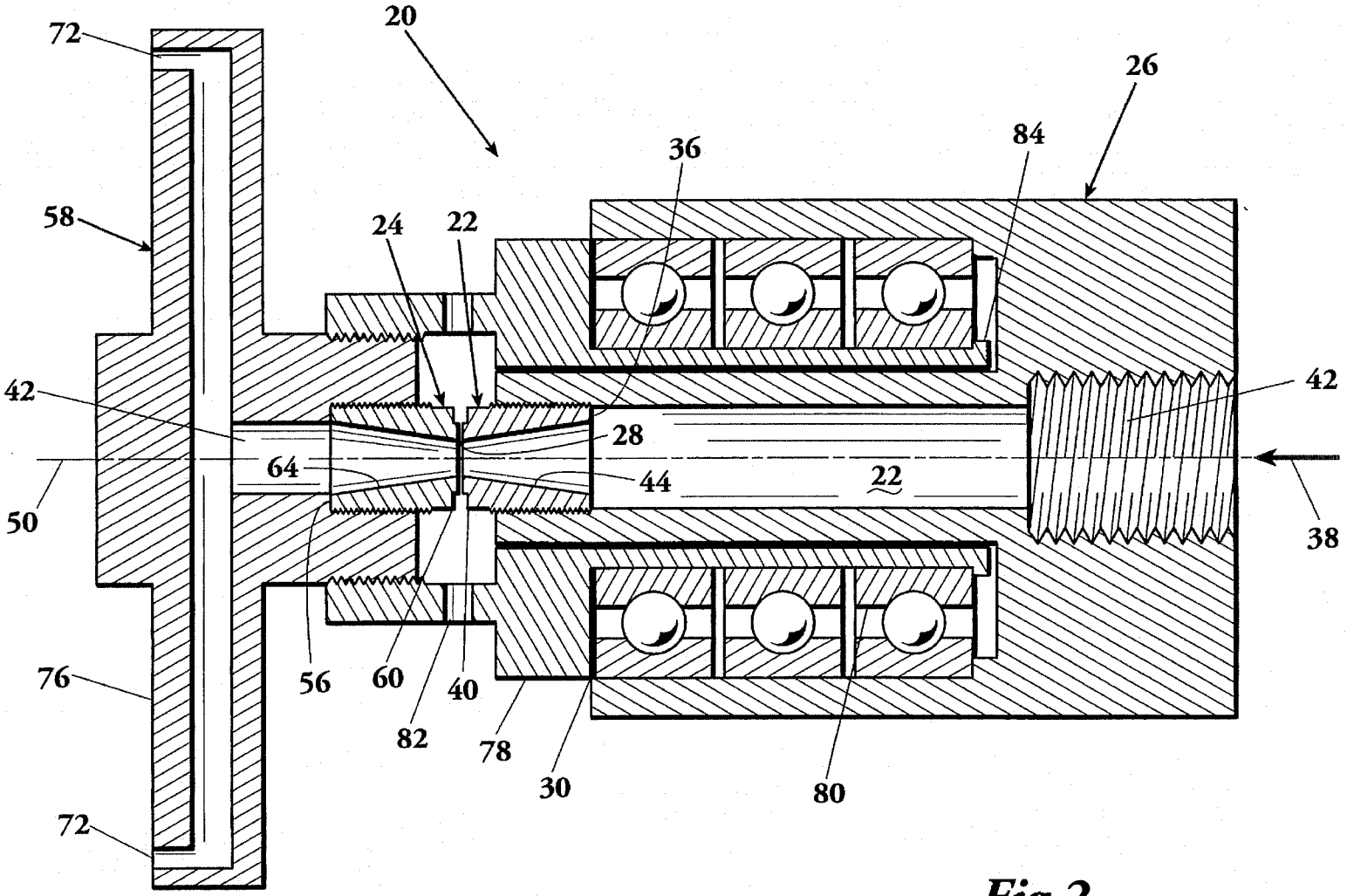
FIG. 2 is a sectional side view of an embodiment of a swivel of the present invention.

Preferred embodiments of the invention will now be described with reference to the drawings and description. Like reference characters refer to like or corresponding parts throughout the drawings and description. FIGS. 1 and 2 present embodiments of the apparatus and method of the fluid-conducting swivel, generally designated 20, of the present invention. Although a preferred embodiment of the swivel 20, described herein to facilitate an enabling understanding of the invention, is a high pressure surface cleaning device, it is intended to be understood that the invention may be adapted to many purposes that require a fluid conducting, swiveling union.

Referring to the example of FIG. 1, the fluid-conducting swivel 20 may be generally described as including an upstream conduit 22, a downstream conduit 24, and support means 26 for allowing rotation of one of the upstream and downstream conduits 22, 24 and for maintaining a space or gap 28 between the upstream and downstream conduits 22, 24. The support means 26 may be designed to allow rotation of both the upstream and downstream conduits 22, 24, as would be known to one skilled in the art in view of the disclosure contained herein. The support means 26 may also be used to hold the upstream and downstream conduits 22, 24 in proper alignment, as is discussed below. The preferred support means 26 includes a bearing assembly 30 (FIG. 2) which may be connected to allow rotation of one or both of the upstream and downstream conduits 22, 24.

Referring to the example of FIG. 1, the upstream conduit 22 has a first end 36 connectable to a fluid source 38, a second end 40, and a fluid passageway 42 extending through the first and second ends 36, 40. The upstream conduit 22 also includes an acceleration nozzle 44 disposed in the fluid passageway 42 for accelerating the velocity of fluid flow. The acceleration nozzle 44 reduces the size of the fluid passageway 42 and thereby provides a means for accelerating the velocity of the fluid flow to such a velocity that the fluid creates a substantially self-contained fluid jet which exerts little or no radially outward pressure and has substantially no dissociation, particularly a point, called a vena contracta, on the fluid jet downstream and outside the second end upstream conduit 40 in the gap 28.

The acceleration nozzle 44 is frusto-conically shaped (in axial cross-section), converges in the direction of fluid flow, and the converging walls 44 form an angle of 40 degrees or less with the axis 50 of the fluid passageway 42 and upstream conduit 22. The preferred acceleration nozzle 44 accelerates the fluid to create a vena contracta by convergence after issuing from the acceleration nozzle 44.

The downstream conduit 24 has a first end 56 connectable to a fluid user 58 (FIG. 2 ) a second end 60 and a fluid passageway 62 extending through the first and second ends 56, 60. The downstream conduit 24 also includes a deceleration nozzle 64 disposed in the fluid passageway 62 for decelerating the velocity of the fluid flow through the fluid passageway 62 and which extends between the first end 56 and the second end 60 of the downstream conduit 24. The deceleration nozzle 64 receives the substantially self-contained fluid jet from the acceleration nozzle 44 before the discharged fluid jet, in the vena contracta form, has time to expand or dissociate.

The preferred deceleration nozzle 64 has substantially the same radially cross-sectional area and shape (with respect to the axis 50 of the downstream conduit 24) as the acceleration nozzle 44. If the deceleration nozzle 64 is substantially larger than the acceleration nozzle 46, the fluid received by the deceleration nozzle 66 will expand and ingest or inspire air or other fluid through the gap 28 which will cause an undesirable irrecoverable pressure loss between the upstream and downstream conduits 22, 24. Being designed and sized to have substantially the same radially cross-sectional area and shape as the acceleration nozzle 44 and to have a substantially constant radially cross-sectional area along its axis 50, the deceleration nozzle 64 will substantially restore the fluid jet to its original velocity and pressure prior to acceleration.

The deceleration nozzle 64 provides a means for enlarging the size of the fluid passageway 62 and thereby decelerates the velocity of the fluid flow through the passageway 62. The preferred deceleration nozzle 64 is frusto-conically shaped (in axial cross-section), diverges in the direction of flow, and has walls 64 which form an angle of 40 degrees or less with the flow axis 50 of the downstream conduit 56. Preferably, the acceleration and deceleration nozzles 44, 64 are substantially identical, inverted and equidistantly spaced from the second ends 40, 60 of the upstream and downstream conduits 22, 24. More preferably, the nozzles 44, 64; upstream and downstream conduits 22, 24 are substantially symmetrical in axial cross-section, as exemplified in FIG. 2.

In a preferred embodiment, referring to the example of FIG. 2, the fluid user 58 includes at least one discharge nozzle 72 in fluid communication with the first end 56 of the downstream conduit 24. The discharge nozzle 72 is displaced radially with respect to the axis 50 of the downstream conduit 24 and is directed downstream along an axis that is skewed with respect to the axis 50 and lies in a plane parallel to the axis 50 in order to cause rotation of the downstream conduit 24 about the axis 50. FIG. 2 exemplifies a prototype of the inventive swivel 20 which is adapted for use as a high-pressure rotating cleaning device such as may be used in cleaning concrete surfaces, cleaning rusted surfaces, cleaning painted surfaces, in rotating car wash nozzles, etc. Since the prototype swivel 20 does not have friction-generating, surface-contacting seals but instead uses the accelerated velocity of the fluid stream to effectively seal the gap 28 between the upstream and downstream conduits 22, 24 and recovers in the order of 97% of the pressure drop used to accelerate the fluid, the fluid pressure may be efficiently used to both rotate the discharge nozzles 72 and clean the desired surface.

Referring to the example of FIG. 2, in the prototype swivel 20, the fluid user 58 includes two diametrically opposed discharge nozzles 72. Each nozzle 72 is displaced radially with respect to the axis 50. The nozzles 72 are directed so that they discharge downstream in the same general direction as the flow through the swivel 20 and downstream conduit 24 along an axis that is skewed or at an angle with respect to the axis 50 and which lies in a plane parallel to the axis 50 in order to cause rotation of the discharge nozzle 72 and downstream conduit 24 about the axis 50. In the prototype swivel 20, the discharge nozzles 72 are equidistantly spaced from the axis 50. The distance between the axis 50 and the discharge axis of the discharge nozzle 72 may be selected to control the speed of rotation of the discharge nozzle 72. Also, the angle at which the discharge nozzles 72 discharge may be selected to control the speed of rotation of the discharge nozzles for a given fluid and discharge pressure, as would be known to one skilled in the art in view of the disclosure contained herein. The speed of rotation will be proportional to the thrust generated at the discharge nozzles and the skew or angle of the discharge nozzles, i.e., since the swivel 20 has no friction-creating sealing surfaces to retard the speed of rotation, the swivel's ability to operate within a broad range of rotational speeds is dependent only on the selection of the bearing assembly 30, the distance the discharge nozzles 72 are displaced from the flow axis 50, and the skew or angle at which the discharge nozzles 72 discharge with respect to the axis 50. In the prototype swivel 20 and fluid user 58, the discharge nozzles 72 are located at the end of conduital arms 76 which transmit the fluid to the nozzles 72 along a flow path about perpendicular to the axis 50 of the downstream conduit 24. In the prototype swivel, the nozzles 72 are skewed an angle of about 20 degree (with respect to axis 50) so that the thrust generated at the nozzles rotates the arms 76.

In the prototype swivel 20, the fluid user 58 is connected to the downstream conduit 24. The downstream conduit 24 and deceleration nozzle 64 may be integrally formed with the fluid user 58 or may be separate components, depending upon the materials of construction. The fluid user 58 is also connected to the bearing retainer 78 so that the fluid user 58 and downstream conduit 24 rotate with the inner bearing race 80. Venting orifices 82 are provided in bearing retainer housing 84 to allow for discharge of any leakage or fluid accumulation, such as will occur if the gap 28 is adjusted so that there is a positive pressure outside the conduits 22, 24 at the gap 28. Three evenly spaced orifices 82 are provided in the prototype swivel 20. The bearing retainer housing 84 is a component of the support means 26 and as such is used to align and position the upstream and downstream conduits 22, 24. The prototype upstream and downstream conduits are positioned so that the acceleration and deceleration nozzles 46, 66 are axially and concentrically aligned along axis 50. The fluid user 58 is threadably engaged with the bearing retainer housing 84 to allow adjustment of the size of the space or gap 28, i.e., to adjust the distance between the second ends 40, 60 of the upstream and downstream conduits 22, 24, as will be further discussed below.

The upstream conduit 22 extends inside the bearing retainer 78 so that the second ends 40, 60 of the upstream and downstream conduits 22, 24 are adjacent. The upstream conduit 22 does not contact the bearing retainer 84. The first end 36 of the upstream conduit is connected to a fluid source 38, which is illustrated as a high pressure fluid connection or fitting which can be connected to a pump, compressor, or other fluid supply. The maximum pressure rating of the swivel 20 is limited only by the strength of the materials of which the swivel 20 and fluid user 58 are manufactured. The first end 36 of the upstream conduit 22 is also connected to the support means 26 which forms the bearing housing, also designated 26. The bearing housing 26 and upstream conduit 22 are fixed so that the downstream conduit 24 and fluid user 58 rotate with respect to the bearing housing 26.

In the prototype swivel 20, the fluid user 58 and downstream conduit 24 are screwed into the bearing retainer housing 84 until contact is made between the second ends 40, 60 of the upstream and downstream conduits 22, 24. The fluid user 58 is then unscrewed just enough to allow rotation of the fluid user 58 and downstream conduit 24 without contact between the second ends 40, 60. This creates a space or gap 28 between the second ends 40, 60 on the order of one or two thousandths of an inch. The space or gap 28 should be adjusted so that there is zero or slightly positive pressure on the outside of the conduits 22, 24 adjacent the gap 28 during operation of the swivel 20, in order to prevent inspiration of air or fluid through the gap and undesirable irrecoverable pressure loss in the fluid flowing through the swivel 20. Normally, the gap 28 will be as small as mechanically possible without the second ends 40, 60 of the conduits 22, 24 making contact. The gap 28 should be sufficiently spaced to accommodate expansion characteristics of the materials of which the swivel 20 is constructed and to allow for thermal expansion of the materials at the operating temperatures of the swivel 20.

As previously mentioned, the fluid user 58 and fluid passageways downstream of the deceleration nozzle 64 should be sized, in view of the anticipated fluid properties and operating pressures within the swivel, to pass the fluid without creating undesirable back pressure in the deceleration nozzle 64 and gap 28. In the prototype swivel 20, the upstream conduit 22 has an internal diameter of 0.272 inches, the acceleration nozzle 46 has an internal diameter of 0.073 inches, and the acceleration nozzle 44 converges at an angle of about 40 degrees. The downstream conduit 24 has an internal diameter of 0.272 inches, the deceleration nozzle 64 has an internal diameter of 0.073 inches, and the deceleration nozzle diverges at an angle of approximately 40 degrees.

Operation—FIGS. 1 and 2

Referring to the examples of FIGS. 1 and 2, the method of operating a fluid-conducting swivel 20 includes accelerating the velocity of a fluid flowing in a fluid passageway 42 from a first end 36 through a second end 40 of an upstream conduit 22; receiving the fluid discharge from the second end 40 of the upstream conduit 22 in a fluid passageway 62 in the second end 60 of a downstream conduit 24 and substantially reducing the diameter of the fluid discharge jet from the acceleration nozzle 44; substantially negating expansion of the fluid jet at the gap 28 before entry into the deceleration nozzle 64 of the fluid passageway 62 of the downstream conduit 24, the deceleration nozzle 64 extending from the second end 60 of the downstream conduit 24 to the first end of the downstream conduit 24; rotatably mounting one of the upstream and downstream conduits 22, 24 for rotation about an axis 50 extending through the adjacent second ends 40, 60 of the upstream and downstream conduits 22, 24; and maintaining a gap 28 between the adjacent second ends 40, 60 of the upstream and downstream conduits 22, 24. The method provides for reducing the size of the fluid passageway 42 with an acceleration nozzle 44 disposed in the upstream conduit 22 and thereby accelerating the fluid velocity to such a velocity that the fluid develops a vena contracta which exerts substantially no outward pressure on the walls of fluid jet while passing through the gap 28.

The method also provides for reducing the size of the fluid passageway 42 with the acceleration nozzle 44 and accelerating the velocity of the fluid flow to such a velocity that the fluid creates a substantially self-contained fluid jet up to the moment of vena contracta and at the moment of vena contracta but not after the moment of vena contracta.

The method provides for the deceleration nozzle 64 having substantially the same cross-sectional area and shape as the acceleration nozzle 46 in order to substantially capture the fluid jet at or before vena contracta before dissociation and expansion of the fluid in the gap 28 between the acceleration and deceleration nozzles 44, 64. The deceleration nozzle 64 provides for receiving the accelerated fluid and restoring the accelerated fluid to its velocity before acceleration by the acceleration nozzle 44.

Summary, Ramifications and Scope

Accordingly, the reader will see that the unique nozzle assemblage and method of using the dynamics of fluid jets to create a durable, useful, and high performance swivel could have an important impact upon users of fluid conducting swivels. An advantage lies in the fact that the inventive swivel is devoid of any mechanical sealing devices, thereby permitting the swivel to be used in corrosive, high-speed rotation, high-pressure, and high-temperature applications. A key element of the present invention is the method of generating a vena contracta in a fluid jet and creating a new use for the vena contracta as a self-sealing fluid jet.

While presently preferred embodiments of the invention have been described herein for the purpose of disclosure, numerous changes in the construction and arrangement of parts and the performance will suggest themselves to those skilled in the art in view of the disclosure contained herein. Thus the scope of the invention should be determined by the appended claims and their legal equivalents, rather than by the examples given.

I claim:

1. A fluid conducting swivel, comprising:

an upstream conical acceleration nozzle having a first end connectable to a fluid source, a second end, and a fluid passageway extending through the first and second ends providing a means for accelerating the velocity of the fluid flow to create a vena contracta; and a downstream conical deceleration nozzle having a first end connectable to a fluid user, a second end, and a fluid passageway extending through the first and second ends, the deceleration nozzle providing a means for decelerating the velocity of the fluid flow; and for receiving the accelerated fluid from the acceleration nozzle at the moment of vena contracta and substantially providing for expansion of the accelerated fluid, thereby substantially preventing pressure loss between the acceleration and deceleration nozzle; and a support means for holding the acceleration and deceleration nozzles with the nozzles aligned, for allowing rotation of one of the nozzles, and for maintaining a space between the nozzles.

2. Swivel of claim 1:

wherein the support means allows rotation of both the acceleration and deceleration nozzles.

3. Swivel of claim 1:

the acceleration nozzle gradually reducing the size of the fluid passageway, thereby accelerating the velocity of the fluid flow to develop a vena contracta.

4. Swivel of claim 1:

the deceleration nozzle gradually increasing the size of the fluid passageway and thereby decelerating the velocity of the fluid to its dynamic characteristics before acceleration in order to substantially prevent pressure loss.

5. Swivel of claim 1, the fluid user comprising at least one discharge nozzle in fluid communication with the first end of the deceleration nozzle and displaced radially with respect to the flow axis of the deceleration nozzle and directed downstream along an axis that is skewed with respect to the flow axis and lies in a plane parallel to the flow axis in order to cause rotation of the deceleration nozzle about the flow axis.

6. A friction-seal-free fluid-conducting swivel comprising:

an acceleration nozzle having a first end connectable to a fluid source, a second end, and a fluid passageway extending through the first and second ends for accelerating the velocity of the fluid flow to create a vena contracta;

a deceleration nozzle having a first end connectable to a fluid user, a second end, and an expansion chamber extending between the first and second ends for receiving the vena contracta and decelerating the velocity of the fluid flow, the deceleration nozzle having substantially the inverse cross-sectional area and shape as the acceleration nozzle; and means for holding the acceleration and deceleration nozzles with the nozzles aligned, for allowing rotation of one of the nozzles, and for maintaining a space between the nozzles.

7. Swivel of claim 6, the fluid user comprising at least one discharge nozzle in fluid communication with the first end of the deceleration nozzle and displaced radially with respect to the flow axis of the deceleration nozzle and directed downstream along an axis that is skewed with respect to the flow axis and lies in a plane parallel to the flow axis in order to cause rotation of the deceleration nozzle about the flow axis.

8. A method of operating a fluid-conducting swivel, comprising the steps of:

(a) accelerating the velocity of a fluid flowing in a converging fluid passageway from a first end through a second end of an upstream acceleration nozzle;

(b) receiving the fluid discharged from the second end of the acceleration nozzle in a fluid stream in a diverging fluid passageway in the second end of a downstream deceleration nozzle and substantially (c) restoring expansion of the fluid discharged from the acceleration nozzle to its original characteristics before acceleration; and substantially (d) preventing expansion of the fluid within a gap between the second end of the upstream acceleration nozzle and the first end of the downstream deceleration nozzle by creating a vena contracta; and (e) rotatably mounting one of the acceleration and deceleration nozzles for rotation about an axis extending through the adjacent second ends of the acceleration and deceleration nozzles; and (f) maintaining a space between the adjacent second ends of the acceleration and deceleration nozzles.

9. Method of claim 8, step (e) comprising: rotatably mounting both the acceleration and the deceleration nozzles.

10. Method of claim 8, step (a) comprising: reducing the size of the fluid passageway with the acceleration nozzle, and accelerating the fluid velocity so that the fluid exerts substantially no pressure on the walls of the fluid stream after leaving the acceleration nozzle.

11. Method of claim 8, step (a) comprising: reducing the size of the fluid passageway with the upstream acceleration nozzle disposed in the fluid passageway and thereby accelerating the velocity of the fluid flow so that the fluid creates a substantially self-contained converging fluid stream up to the point of vena contracta.

12. Method of claim 11 in which the acceleration nozzle has a substantially conical cross-sectional area in order to accelerate the velocity of the fluid to create the self-contained fluid stream.

13. (Amended) Method of claim 12:

wherein the deceleration nozzle has substantially an inverted cross-sectional area and shape as the acceleration nozzle and is turned around in order to restore fluid flow to substantially the same characteristics that existed prior to acceleration of said flow.

14. A method of operating a fluid-conducting swivel comprising the steps of:

accelerating the velocity of a fluid flowing in a converging fluid passageway from a first end through a second end of an upstream acceleration nozzle;

receiving the fluid discharged from the second end of the acceleration nozzle as a fluid stream in a diverging fluid passageway in the second end of a downstream deceleration nozzle to substantially:

restore expansion of the fluid discharged from the acceleration nozzle to its original characteristics before acceleration; and prevent expansion of the fluid within a gap between the second end of the upstream acceleration nozzle and the first end of the downstream deceleration nozzle by creating a vena contracta in the fluid stream at the gap;

permitting one of the acceleration and deceleration nozzles to rotate about an axis extending through the adjacent second ends of the acceleration and deceleration nozzle; and maintaining a space between the adjacent second ends of the acceleration and deceleration nozzles.

* * * * *